US006354373B1

(12) United States Patent
Vercaemer et al.

(10) Patent No.: US 6,354,373 B1
(45) Date of Patent: Mar. 12, 2002

(54) EXPANDABLE TUBING FOR A WELL BORE HOLE AND METHOD OF EXPANDING

(75) Inventors: Claude J. Vercaemer; Hubertus V. Thomeer, both of Houston, TX (US); Robert M. Sorem, Lawrence, KS (US)

(73) Assignee: Schlumberger Technology Corporation, Houston, TX (US)

( * ) Notice: Subject to any disclaimer, the term of this patent is extended or adjusted under 35 U.S.C. 154(b) by 0 days.

(21) Appl. No.: 09/200,345

(22) Filed: Nov. 25, 1998

Related U.S. Application Data

(60) Provisional application No. 60/066,827, filed on Nov. 26, 1997.

(51) Int. Cl.[7] ..... E21B 29/00; E21B 23/00

(52) U.S. Cl. ..... 166/277; 166/207

(58) Field of Search ..... 166/77.2, 77.3, 166/207, 227, 277, 381, 385

(56) References Cited

U.S. PATENT DOCUMENTS

| | | | | | |
|---|---|---|---|---|---|
| 341,327 | A | * | 5/1886 | Fay | 166/207 |
| 1,652,650 | A | * | 12/1927 | Watson et al. | 166/227 |
| 2,214,226 | A | | 9/1940 | English | |
| 2,447,629 | A | | 8/1948 | Beissinger et al. | |
| 2,734,580 | A | | 2/1956 | Layne | |
| 3,028,915 | A | * | 4/1962 | Jennings | 166/277 |
| 3,054,455 | A | | 9/1962 | Keltner | |
| 3,326,293 | A | | 6/1967 | Skipper | |
| 3,353,599 | A | * | 11/1967 | Swift | 166/207 X |
| 3,364,993 | A | | 1/1968 | Skipper | |
| 3,477,506 | A | | 11/1969 | Malone | |
| 3,489,220 | A | * | 1/1970 | Kinley | 166/277 |
| 3,691,624 | A | | 9/1972 | Kinley | |
| 3,785,193 | A | | 1/1974 | Kinley et al. | |
| 3,948,321 | A | | 4/1976 | Owen et al. | |
| 4,308,736 | A | | 1/1982 | Lowe et al. | |
| 4,495,997 | A | | 1/1985 | Scott et al. | |
| 4,501,327 | A | * | 2/1985 | Retz | 166/277 X |
| 4,716,965 | A | | 1/1988 | Bol et al. | |
| 4,830,109 | A | | 5/1989 | Wedel | |
| 4,976,322 | A | | 12/1990 | Abdrakhmanov et al. | |
| 5,014,779 | A | | 5/1991 | Meling et al. | |
| 5,083,608 | A | | 1/1992 | Abdrakhmanov et al. | |
| 5,200,072 | A | | 4/1993 | Frejborg et al. | |
| 5,337,823 | A | * | 8/1994 | Nobileau | 166/277 |
| 5,348,095 | A | | 9/1994 | Worrall et al. | |
| 5,366,012 | A | | 11/1994 | Lohbeck | |
| 5,494,106 | A | | 2/1996 | Gueguen et al. | |
| 5,613,557 | A | * | 3/1997 | Blount et al. | 166/277 |
| 6,012,522 | A | * | 1/2000 | Donnelly et al. | 166/207 X |

FOREIGN PATENT DOCUMENTS

| | | | | |
|---|---|---|---|---|
| SU | 1051222 | * | 10/1983 | 166/207 |
| SU | 1747673 A1 | | 7/1992 | |
| WO | 93/25799 | * | 12/1993 | 166/207 |

* cited by examiner

*Primary Examiner*—Dennis L. Taylor
(74) *Attorney, Agent, or Firm*—John J. Ryberg; Victor H. Segura

(57) ABSTRACT

An expandable tubing (12) for a well bore hole (14) in which selected length portions (24, 26, 28) are weakened by a slot configuration (FIGS. 2, 3, 4) to obtain predetermined expansion characteristics. The slot configurations are tailored or selected for a predetermined bore hole length and may be expanded to different radial diameters to conform generally to the peripheral contour of the bore hole. Tubing portions (29) between the slotted length potions (24, 26, 28) are unweakened.

21 Claims, 4 Drawing Sheets

FIG. 1
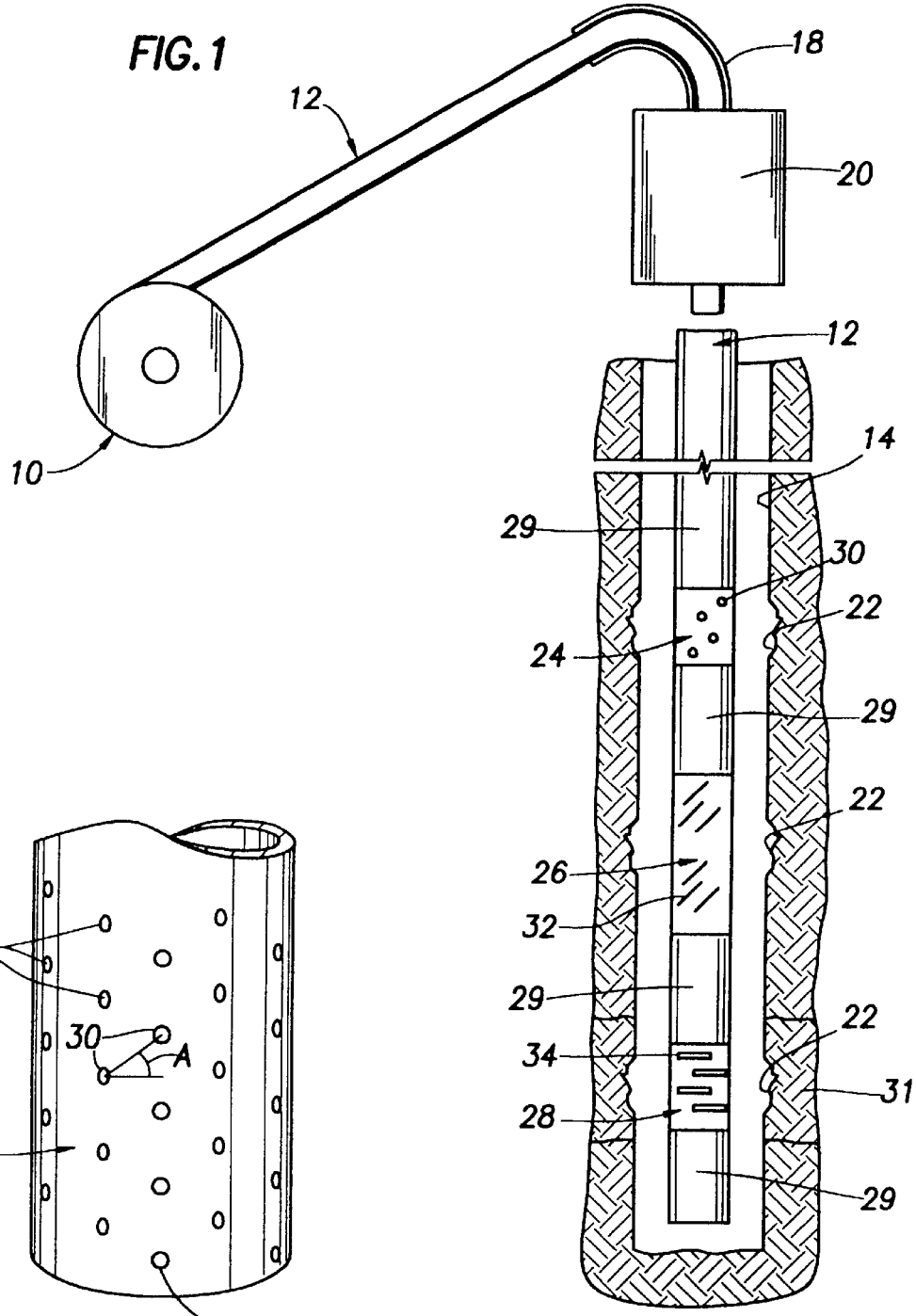
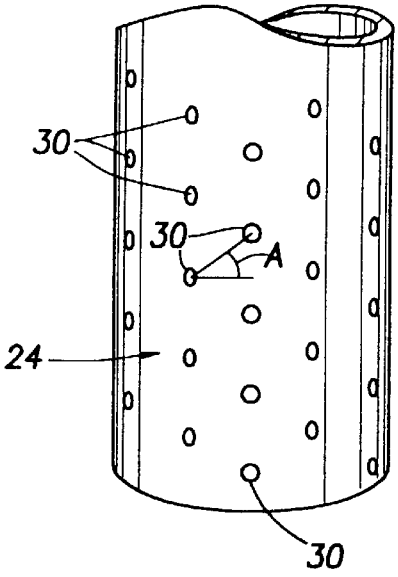
FIG. 2

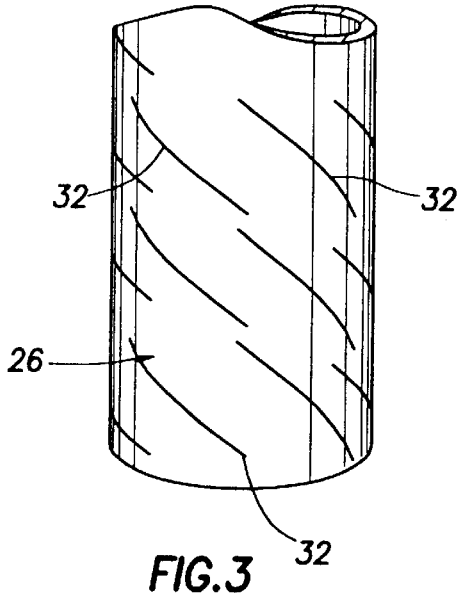
FIG.3
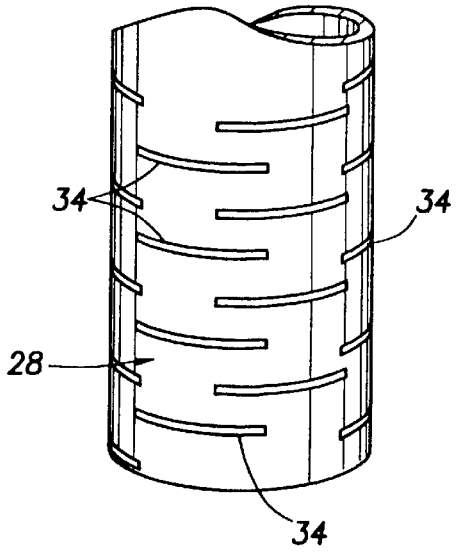
FIG.4
FIG.5
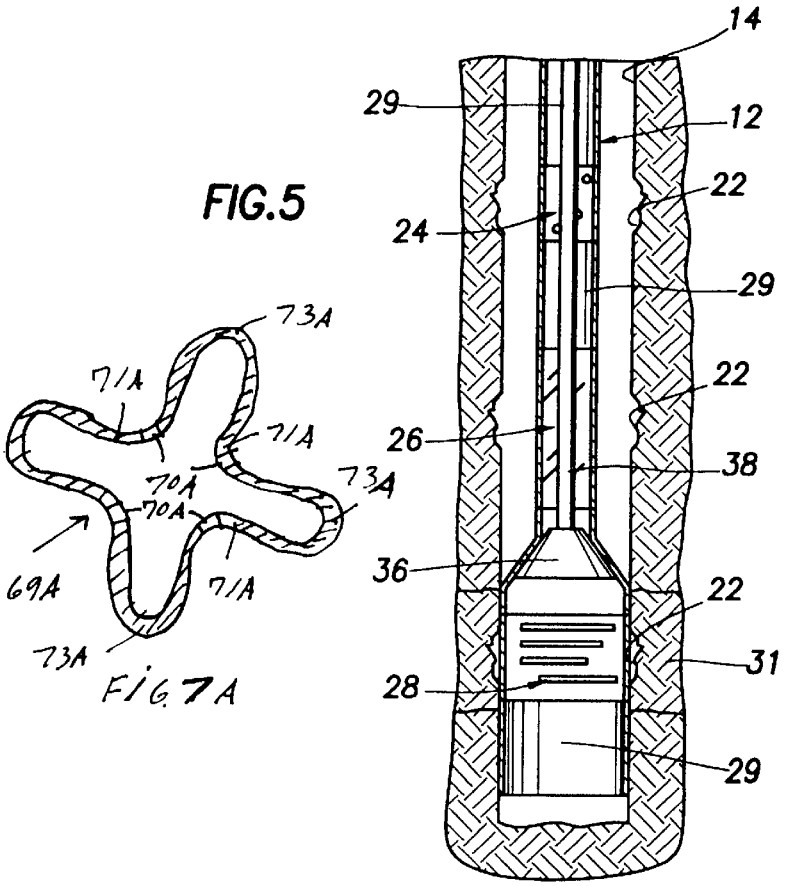
FIG.7A

FIG.6
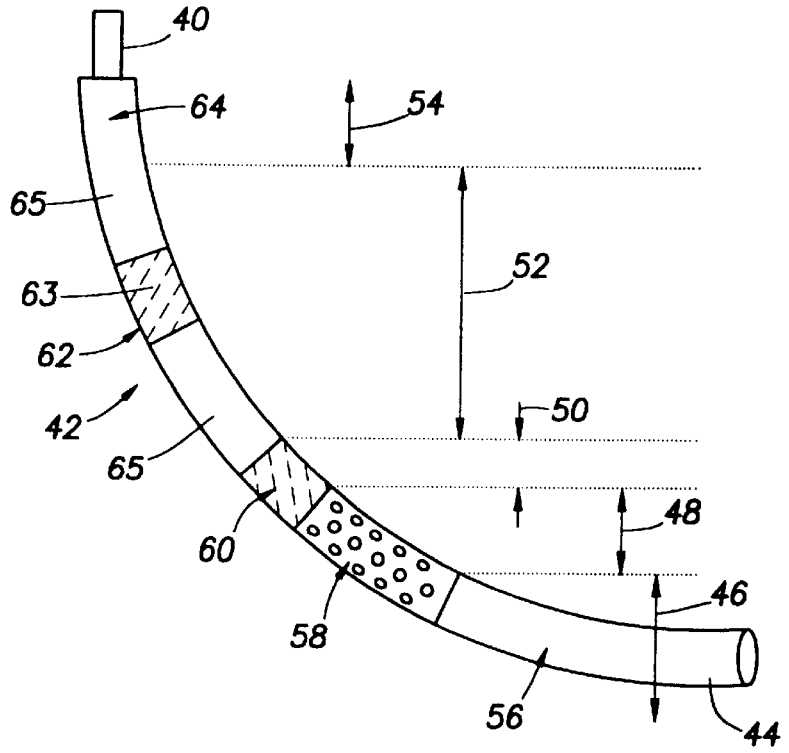
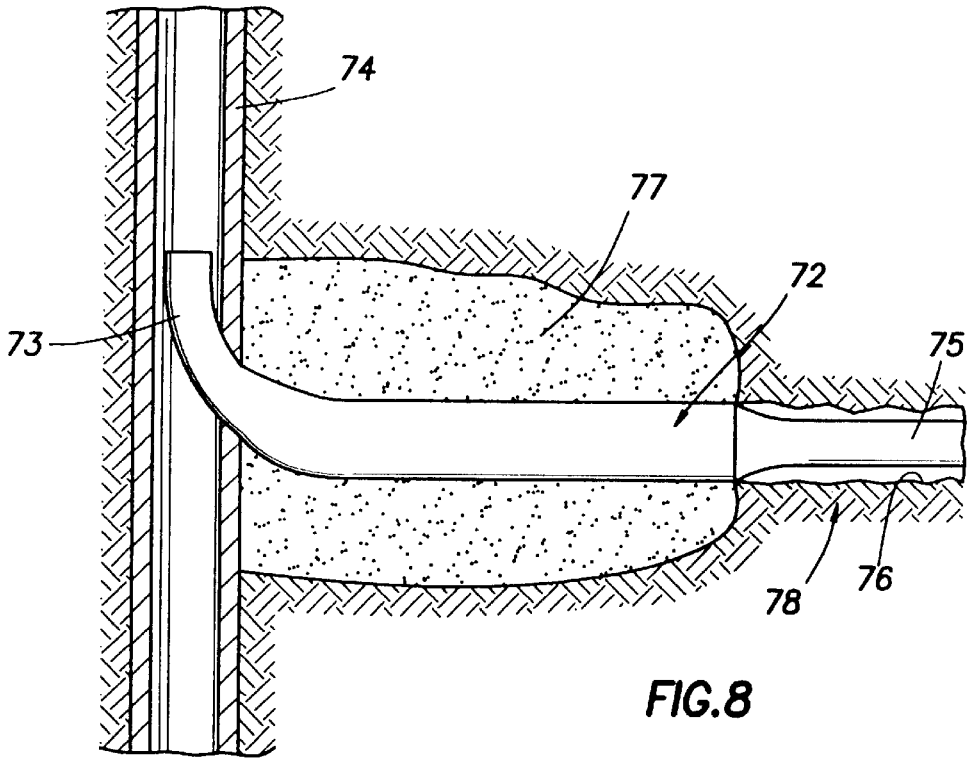
FIG.8

FIG.9
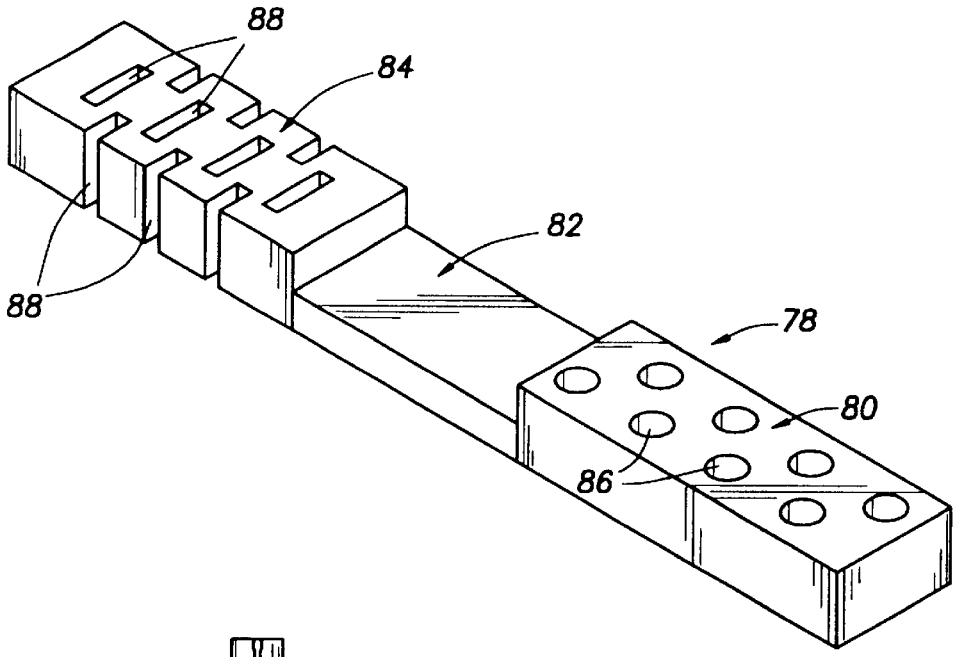
FIG.10
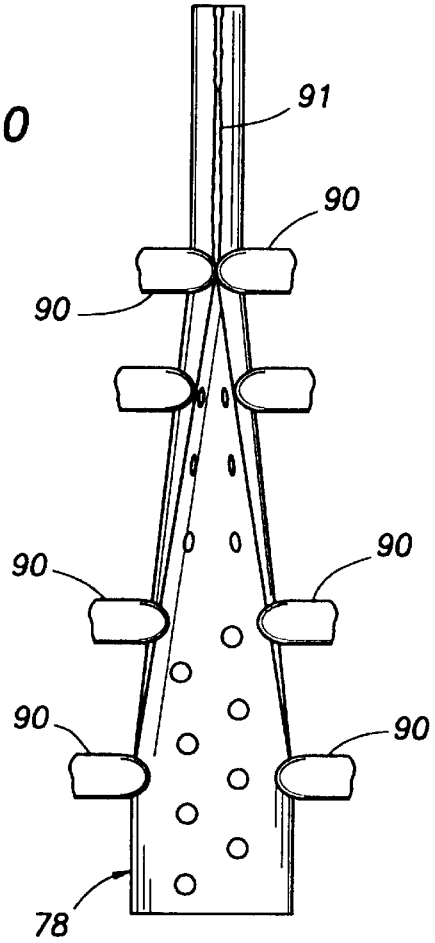
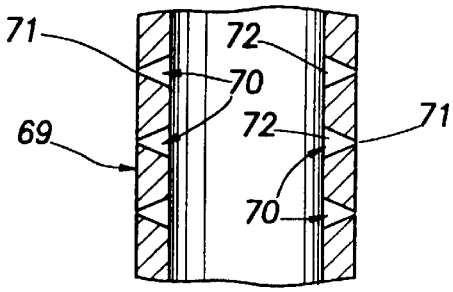
FIG.7

EXPANDABLE TUBING FOR A WELL BORE HOLE AND METHOD OF EXPANDING

REFERENCE TO RELATED PROVISIONAL APPLICATION

This application claims the benefit of U.S. Provisional Application Serial No. 60/066,827 filed Nov. 26, 1997.

FIELD OF THE INVENTION

This invention relates to expandable tubing for a well bore hole and the method for expanding the tubing within the bore hole.

BACKGROUND OF THE INVENTION

Heretofore, expandable tubing has been utilized in a bore hole particularly as a liner for both a cased hole section of a well bore and an uncased hole section of a bore hole. The liner is normally expanded until it contacts the bore wall which is formed by the adjacent formation or a casing. A mandrel of a diameter greater than the internal diameter of the expandable tube is normally used for radial expansion of the tubing.

The tubing may be slotted to assist in expansion and expandable slotted tubing (EST), (as shown in U.S. Pat. No. 5,366,012 dated Nov. 22, 1994), may be used in various downhole applications. The tubing comprises lengths of tube which have been machined to create a large number of axial extending elongate slots arranged in an overlapping relation. Thus, it is relatively easy to expand the tube radially outwardly by, for example, running a mandrel through the tubing. The expansion causes the axially extending overlapping elongate slots to extend to create diamond-shaped apertures. The tubing is useful where it is desired to, for example, line a bore below a restriction without further reducing the diameter of the bore. Using conventional tubing the outer diameter of the tubing must, by necessity, be of smaller diameter than the restriction, to permit the tubing to be passed through the restriction. This reduction in the bore diameter has a number of significant effects, primarily in reducing the production capabilities of the bore. Using EST, the tubing may pass through a restriction into a reamed section of bore below the restriction. The tubing may then be expanded to a diameter larger than the restriction.

EST is supplied in lengths which are, at present, made up into a string by welding the lengths to one another. This is relatively time consuming and expensive and in may situations, for example in an off-shore operation in bad weather, it may be difficult to maintain consistent weld quality. Safety problems may also arise due to the high temperatures and exposed flames or sparks created by a welding operation. Further, in the event of a "mis-run", requiring the welded lengths of tube forming the EST string to be separated, the tubing must be cut, and the cut tubing may not be suitable for re-use.

As described in International Publication No. W096/37680 published Nov. 28, 1996; a connector assembly for interconnecting sections of an expandable slotted tubing string is provided with connected parts being slotted to permit expansion of the coupled parts.

As used herein, the term "slotted" or "slots" is interpreted as including any cutting, machining or weakening of a tubular structure intended to facilitate radial expansion, including, but not limited to: openings, elongate slots, indentations, marks or slits which extend through or partially through the tube wall and which permit the remaining thinned wall sections to fracture or extend; holes which extend through the tube wall including drilled openings in various patterns such as tapered frusto-conical openings; and reduced thickness wall portions. The term "tube" or "tubing" is interpreted as including coiled tubing and jointed tubular sections.

However, heretofore, there has been no tailoring of slots for a predetermined bore hole length portion and only a single slot pattern for tubing has been provided heretofore. Thus, the most desirable slot pattern for a particular bore hole length may not be obtained. The bore hole may include various length portions for expandable tubing which require different expansion characteristics for the expandable tubing when transversely aligned with predetermined bore hole length portions.

It is an object of this invention to provide expandable tubing having length portions with different predetermined expansion characteristics so that transversely aligned bore hole length portions having different diameters resulting particularly from collapsing obtain the desired radial expansion from the adjacent transversely aligned slotted tubing.

Another object is to provide tubing for a well bore hole with the tubing having predetermined weakened length portions thereof with different predetermined radial expansion characteristics for different length portions of the well bore hole.

A further object is to provide a tubing for an open bore hole having expandable slotted length portions for the injection of fluids for isolation of a zone.

A further object is the provision of a method for inserting and expanding tubing within a bore hole and including longitudinally spaced length portions of the tube with different predetermined slot configurations for expansion to predetermined radial diameter conforming to adjacent diameter portions of the bore hole.

SUMMARY OF THE INVENTION

The present invention is particularly directed to a system for expandable slotted tubing (EST) for a bore hole in which predetermined length portions of the tubing are provided with different slot patterns or configuration tailored for a corresponding bore hole length portion when transversely aligned with the corresponding bore hole length portions. For example, the bore hole length portion in a gas zone may require a slot configuration for a transversely aligned length portion of the expandable slotted tube different from the slot configuration in a length portion of the expandable slotted tube against an oil bearing or said producing zone of the bore hole. Also, for example, a slot configuration for the EST particularly adapted for receiving a polymer gel or other material which is injected through the EST in the formation adjacent the EST for isolating or fracturing the adjacent formation. The slot pattern or configuration for a predetermined length portion of the expandable slotted tube may be practically endless and various configurations of slits, slots, holes, and weakened portions, for example, may be utilized. The slot pattern for a predetermined length portion is determined by the particular expansion characteristics desired for the corresponding bore hole length portion.

The present invention is also directed to the plastic deformation of weakened length portions of tubing with various configurations for the weakened length portions tailored for a predetermined transversely aligned bore hole length. Nonlinear finite element analysis (FEA) has been performed on various slots including circular holes and elongate slot configurations for providing the weakened portion of the tubing at predetermined length portions thereof.

The term "slot" or "slots" as interpreted above includes circular holes, tapered frusto-conical openings, elongate slots, and slits in addition to other weakening elements for the expandable tubing as interpreted above. In some predetermined length portions of the tubing, the length portions are not weakened in any manner and in some instances, the major length of the tubing may not be weakened. Circular openings and elongate slots arranged in a non-overlapping angular relation to each of about 45 degrees have been found to be preferable for weakening predetermined length portion of the tubing.

The predetermined pattern for predetermined weakened length portions along the length of the tubing may be created on a strip material with the strip then being rolled and welded. Expansion of the predetermined length portion of the tubing may be achieved, for example, by pressurized fluid or gas, mechanical expansion tools utilizing hydraulic fluid, or explosives.

Normally, a caliber survey of the well bore is performed to determine the design requirements for the weakened portions of the tubing.

Other features and advantages of the invention will become more apparent from the following specification and drawings.

BRIEF DESCRIPTION OF THE DRAWINGS

FIG. 1 is an elevational view of a well bore hole having a casing therein with coiled tubing comprising the present invention injected within the bore hole with predetermined weakened length portions of the tubing transversely aligned with defective length portions of the casing for being expanded;

FIG. 2 is an elevational view of one slot pattern for providing a weakened length portion in the tubing;

FIG. 3 is an elevational view of another slot pattern for providing a weakened length portion in the tubing;

FIG. 4 is an elevational view of a further slot pattern for providing a weakened length portion in the tubing;

FIG. 5 is a schematic view of the expandable sections with a mandrel shown for expanding the section;

FIG. 6 is a schematic view of a deviated well bore hole with different slotted sections for different well zones in the bore hole;

FIG. 7 is an enlarged tubing section showing frusto-conical openings through the wall of the tubing and adapted for use as a sand screen in a gravel pack operation;

FIG. 7A is a cross sectional view of a convoluted tubular member to form the tubing section of FIG. 7 when expanded;

FIG. 8 is a schematic view of a deviated well bore in which an expandible porous or leaky tubing is positioned in the deviated section between impermeable tubing sections and utilized for injection into the zone;

FIG. 9 is a schematic view of a strip material from which the tubing is formed and showing various slotted patterns in the strip; and FIG. 10 is a schematic view of a method for rolling the strip material into a tube for welding along a longitudinal seam to form the tubing.

DESCRIPTION OF THE INVENTION

Referring now to the drawings for a better understanding of the invention, an embodiment of this invention is shown in FIGS. 1–5 in which a coiled tubing apparatus is provided for injecting coiled tubing within a well bore hole as illustrated particularly in FIG. 1. A coiled tubing reel shown generally at 10 has coiled tubing 12 thereon which has been provided with predetermined weakened or slotted length portions for transverse alignment with mating length portions in an open well bore hole shown generally at 14 and having different diameter portions resulting from collapsing or washed out wall portions. Coiled tubing 12 from reel 10 is directed by guide 18 into an injector 20 for pushing or injecting coiled tubing 12 within bore hole 14. Bore hole 14 has a plurality of collapsed portions shown at 22 which are desired to be strengthened by coiled tubing 12 which forms an expandable liner for the open bore hole. Coiled tubing 12 as shown in FIG. 1 is formed with three different slot patterns shown in length sections or portions 24, 26, and 28 for transverse alignment with length portions 22 of bore hole 14 subject to collapsing. Tubing length section 24 as shown in FIG. 2 has a plurality of circular openings or holes 20 with adjacent holes 20 being staggered and in an angular relation to each other preferably about forty five (45) degrees such as illustrated by angle A in FIG. 2.

Length portion 26 has a plurality of slits 32 extending in an angular relation to the longitudinal axis of coiled tubing, such as forty five degrees. While slits 32 are shown, elongate slots or slits with enlarged end openings could be provided, if desired. Tubing length portion 28 is provided with horizontal extending slits 34 with adjacent slots 34 overlapping each other. Solid or non-weakened length portions 29 are provided on opposed ends of length portion 28 for isolation of a desired zone 31 such as an oil or gas production zone. A solid length portion 29 is also provided above length portion 24. Thus, it is apparent that different expansion characteristics are obtained with different slot configurations tailored for a specific length portion of the bore hole and adaptable for different bore hole diameters.

FIG. 5 shows one arrangement for the expansion of the expandable sections by an upwardly tapering expansion mandrel 36 on the lower end of string 38. Expansion mandrel 36 has a diameter which is larger than the inner diameter of tubing 12. A mandrel 36 may be provided on the end of the coiled tubing 12 and inserted with the coiled tubing. For pulling of the mandrel 36 by string 38 the coiled tubing 12 is cut below injector 20 and string 38 pulled upwardly by suitable apparatus.

The arrangement shown in FIG. 5 provides a generally uniform expansion of the expandable coiled tubing 12. However, it is desirable to have selected expandable length portions of coiled tubing 12 expand radially outwardly a greater distance than other length portions so that coiled tubing 12 fits against enlarged diameter portions of the open bore hole. For this purpose, pressurized fluid or mechanically expandable tools controlled by hydraulic fluid for radial expansion may be utilized to expand the selected length portions of coiled tubing 12. The slot pattern for such selected length portion is selected to provide an easily expandable section at relatively low force levels. Explosives may also be provided for expanding selected length portion of the coiled tubing 12.

As a specific means for relatively effecting radial expansion of tubing 12, reference is made to U.S. Pat. No. 3,818,734 dated Jun. 25, 1974 in which a plurality of vertically spaced balls extend radially different distances for expanding a tubular member. If desired, various sleeves could be positioned behind the balls and hydraulically actuated selectively from a surface location to extend selective balls a predetermined radial distance for expanding a desired length portion of the tubing a predetermined amount at the different diameter portions in the well bore.

While coiled tubing has been shown in FIGS. 1–5, jointed pipe with expandable sections could be provided with the expandable sections having predetermined expansion characteristics. The term "tube" or "tubing" is interpreted as including jointed pipe or tube sections. While a casing has not been shown in the embodiment of FIGS. 1–5, the arrangement shown in FIGS. 1–5 could be utilized a cased bore hole, if desired. Tubing 12 with selected weakened portions may be utilized for various purposes including sand control, zone isolation, patching of existing downhole tubular members, water and/or gas shutoff, and isolation from a main bore hole to a lateral bore hole, for example.

Referring to FIG. 6, another embodiment of the present invention is shown generally schematically for various zones in a deviated well bore. An upper vertical casing to the surface is shown at 40 and an open bore hole extends from casing 40 in a lateral direction. A transition length of tubing is shown generally at 42 extending within the open bore hole to open lateral bore hole portion 44. The deviated length of tubing 42 extends through various zones including a water zone 46, an oil zone 48, a gas zone 50, a non-producing zone 52, and an open hole 54. Tubing 42 has been provided with predetermined length portions tailored for each of the zones 46–54. Tubing length portions 56, 58, 60, 62 and 64 are arranged for transverse alignment with respective zones 46, 48, 50, 52 and 54. Tubing length portion 58 is weakened with circular openings 30 as shown in FIG. 2 and tubing length portion 60 is weakened with slits 32 as shown in FIG. 3. Tubular length portions 62 is also weakened with an intermediate slotted area 63 with adjacent unweakened solid end sections 65. Length portions 56 and 64 are also unweakened solid portions as shown in FIG. 6.

FIG. 7 is an enlarged section of a tubing length 69 having a slit pattern comprising a plurality of tapered frusto-conical openings 70 through the wall of tubing length 69. Tubing length 69 forms a sand screen adapted for utilization in a gravel pack operation to limit sand from entering frusto-conical openings 70. The entrance 71 to openings 70 has a diameter of about 0.300 inch and the exit 72 has a diameter of about 0.020 for a 0.250 inch wall thickness.

Referring to FIG. 7A, a cross sectional view of a tubing member is shown at 69A of a convoluted shape having generally circular holes or openings 70A in the innermost wall surfaces of tubing member 69A defined by inner arcuate portions connected to intervening arcuate portions 73A. When expanded outwardly by a suitable expansion tool, the shape is as shown in FIG. 7 is formed to provide tapered frusto-conical openings 72. Elongate slots or elongate openings would also function in a manner to provide the frusto-conical or tapered openings.

FIG. 8 is a schematic of another embodiment in which expandable tubing generally indicated at 72 in a transition section is provided between a vertical unweakened solid tube 73 in vertical casing 74 and a horizontal solid tube 75 in an uncased horizontal bore hole portion 76. Expandable transition tubing 72 is a porous expandable tubing section and a polymer gel is injected into expandable tubing 72 to isolate a non-producing permeable zone 77 from a reservoir or producing zone shown at 78. The bore hole portion for transition section 72 is of a larger diameter than the bore hole portion 76 for solid tube 75. The tubing in transition section 72 has a slot pattern for expansion with a relatively low expanding force. Fluid is injected in zone 77 for preventing communication from zone 78 to the casing 74.

FIG. 9 is a schematic of a flat strip material shown generally at 79 which is provided with predetermined weakened length portions shown at 80, 82, and 84. Length portion 80 includes circular openings 86 while length portion 84 includes horizontal elongate slots 88. Connecting length portion 82 is formed of a reduced thickness to provide a weakened length portion. The flat strip material 78 from which tubing is formed may be provided with any desired pattern of weakened length portions.

As shown in FIG. 10, the flat strip material 79 for forming the tubing is fed through a rolling apparatus in which a plurality of opposed rollers 90 contact and fold in sequence flat strip material 79 into a circular tubing. A seam 91 along the tubing is welded by suitable welding apparatus as well known to complete the process of forming the tubing.

The orientation of circular holes with respect to one another is important. If the holes are aligned circumferentially, then locally high and low stresses will occur. The length of tubing having the circular holes will deform easily and to a much greater extent than the length of tubing without holes. Without the circular holes, the tubing will deform until the failure limit is reached. One would typically reach only 10 to 30% expansion depending on the material. By staggering the circular holes, optimally at a 45° angle, maximum expansion is obtained.

The end shape of the holes is also important. If the end is too sharp, cracks will form during the plastic deformation process causing premature failure. Therefore, numerous very small holes are not as effective as fewer large holes. Theoretically, a sharp point will cause very high stresses thus inducing failure. Plastic deformation blunts crack growth to a certain extent, but considering the large amount of deformation required for this application, premature failure is imminent.

Typical elongate opening or elongate slot designs use axially oriented elongate openings. When the oriented elongate openings expand the resulting opening size is dependent on the length and amount of expansion. Longer elongate openings provide both larger expansion sizes and larger openings. If thin elongate openings are required then large circular holes should be provided at the ends of the elongate to stop crack growth. Elongate slots oriented at angles other than axial will induce rotations of the materials during expansion. As the elongate slots approach the circumferential direction the amount of deformation is directly controlled by the limits of the material regardless of size. The optimum relationship between elongate slots would be alignment of the ends of the slots or openings at a 45° angle to provide maximum plastic deformation. The results of the FEA are as follows:

Finite Element Analysis (FEA)

Several different hole/slot configurations were modeled using nonlinear finite element analysis. All modeling was performed using 10 node tetrahedron solid elements. Material properties were modeled as steel with a yield strength of 80 ksi, an elastic modulus of 30e3 ksi, and a tangent modulus of 100 ksi. This is simply a generic steel. No failure point was assumed. As flat as possible plastic stress-strain curve was used. The maximum circumferential plastic strain is recorded in Table 1 for the different configurations. All the figures are plotted with a displacement of 0.2 inches applied. Results for higher deformation are very similar with higher numbers.

The tubing was modeled as 8.5" outside diameter with a 0.125" wall. A small section was modeled in each case to be representative as possible. The cut section was constrained by symmetry in the circumferential direction and allowed to move in the horizontal direction as a planar section.

The first model is simply a 4 hole design with axially and circumferentially oriented holes. Results indicate high strains for low deformation. The second model adds a hole in the center of the pattern, giving a 45 degree bias to the system. Plastic strains are plotted in FIG. 2. Strains are reduced nearly in half simply by adding this hole making it a very good alternative.

Three different slot models were analyzed. The first is with four (4) slots extending horizontally. The second adds an elongate slot in the center of the other elongate slots, and the last has four (4) circumferentially oriented elongate slots. The design having five (5) horizontal slots had the lowest strains. As expected, circumferentially oriented elongate slots provide very little expansion prior to failure. The holes were circular openings and the slots were elongate slots.

TABLE 1

Plastic Strain Results for FEA

| Displacement | 4 Holes | 5 Holes | 4 Hori. Slots | 5 Hori. Slots | 4 Vert. Slots |
|---|---|---|---|---|---|
| 0.2 | 0.198 | 0.102 | 0.151 | 0.0268 | 0.262 |
| 0.4 | 0.377 | 0.207 | 0.287 | 0.0505 | 0.473 |
| 0.6 | 0.542 | 0.314 | 0.412 | 0.0726 | 0.663 |
| 0.8 | 0.697 | 0.420 | 0.529 | 0.109 | 0.832 |
| 1.0 | 0.843 | 0.526 | 0.640 | 0.148 | 0.988 |
| 1.2 | 0.984 | 0.629 | 0.746 | 0.189 | 1.138 |
| 1.4 | 1.119 | 0.733 | 0.849 | 0.231 | 1.284 |
| 1.6 | 1.25 | 0.834 | 0.949 | 0.274 | 1.428 |
| 1.8 | 1.379 | 0.934 | 1.046 | 0.318 | 1.571 |
| 2.0 | 1.505 | 1.034 | 1.141 | 0.362 | 1.712 |

Five (5) inch Expanded Tube or Pipe

Variable Thickness

A more detailed analysis was performed on 5" OD pipe expanded to 7" OD maximum. The material properties are the same as in the above example. Hole centers are located on 3/16 ". Results are shown in Table 2 for various pipe thicknesses. Obviously from this analysis, an optimum thickness exists for a given configuration. Too thin of pipe will lead to extreme local deformations and high plastic strains. Too thick of pipe will lead to over constraint of the system and high plastic strains. The ideal thickness will be dependent primarily on the pipe diameter, the hole size and hole orientation.

TABLE 2

Plastic Strain Results for 5" Pipe with Various Thicknesses

| Displacement | 1/16" Thickness | 1/8" Thickness | 1/4" Thickness |
|---|---|---|---|
| 0.2 | 0.231 | 0.117 | 0.146 |
| 0.4 | 0.447 | 0.218 | 0.304 |
| 0.6 | 0.653 | 0.311 | 0.459 |
| 0.8 | 0.852 | 0.397 | 0.611 |
| 1.0 | 1.044 | 0.480 | 0.758 |

Variable Hole Diameter

Results are shown in Table 3 for the effects of hole size for a given hole pattern (45 degree orientation) and hole centers location. The larger hole on smaller centers provides initially smaller strains due to the small amount of material, but leads to higher strains at the final deformation. Based on this analysis the optimum orientation utilizes the same hole size and hole center.

TABLE 3

Plastic Strain Results for 5" Pipe with Various Hole Sizes

| Displacement | 0.15625" Hole | 0.1875" Hole | 0.21875" Hole | 0.25" Hole |
|---|---|---|---|---|
| 0.2 | 0.209 | 0.117 | 0.187 | 0.102 |
| 0.4 | 0.418 | 0.218 | 0.376 | 0.218 |
| 0.6 | 0.623 | 0.311 | 0.559 | 0.339 |
| 0.8 | 0.824 | 0.397 | 0.738 | 0.463 |
| 1.0 | 1.02 | 0.480 | 0.914 | 0.589 |

Expansion Forces

The various forces required to expand the tubing were also studied. Results are shown in Table 4 for the above examples. The forces are listed in lbs/inch of length. The predicted loads are not necessarily exact, but their relationship with one another is valid. The 5 horizontal slot configuration is the easiest to deform while the 4 hole or vertical slot configurations are the most difficult. The loads are directly proportional to the diameter of the tubing so the 5" OD pipe would have correspondingly less deformation forces.

TABLE 4

Deformation Forces from FEA

| Displacement | 4 Holes | 5 Holes | 4 Hori. Slots | 5 Hori. Slots | 5 Hori. Slots |
|---|---|---|---|---|---|
| 0.1 | 43400 | 30200 | 19100 | 15400 | 42000 |

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A lining tube for a well bore hole to expand against predetermined length portions of the bore hole; said lining tube having selected length portions in transverse alignment with said bore hole length portions and constructed for controlled radial expansion against said bore hole length portions relative to the remainder of said lining tube, and relieving means at each of said selected length portions for relieving said selected length portions in response to the application of force, said relieving means being varied at different selected length portions to provide different predetermined expansion characteristics for different selected length portions.

2. A lining tube as set forth in claim 1 wherein said relieving means include openings of different predetermined patterns in said selected length portions to provide different expansion characteristics for different selected length portions.

3. A lining tube as set forth in claim 1 wherein said relieving means include slots arranged in different predetermined patterns in said selected length portions to provide different expansion characteristics for said selected length portions.

4. A lining tube as set forth in claim 1 wherein said relieving means include weakened cross sectional areas of said selected length portions formed by reduced thicknesses of the wall of said tube, said weakened cross sectional areas being varied at different selected length portions to provide different expansion characteristics for different selected length portions.

5. A lining tube as set forth in claim 1 wherein said relieving means include slits of different patterns in said selected length portions to provide varied predetermined expansion at said selected length portions.

6. A tubular lining member for a well bore hole having predetermined length portions thereof that are constructed for a controlled predetermined radial expansion in response to different well bore hole characteristics, said length portions of said liner member being positioned along the length of said well bore hole and having a predetermined length portion thereon in transverse alignment with a selected bore hole length portion to be reinforced, and relieving means for relieving said predetermined length portions to permit expansion of said length portions, said relieving means being selectively varied for different length portions to provide different expansion amounts as may be predetermined for said different length portions.

7. A tubular lining member as set forth in claim 6 wherein said relieving means for some of said selected length portions comprise circular openings therein and said relieving means for other of said selected length portions comprise elongate slits.

8. A continuous lining tube for a well bore hole to expand against predetermined length portions of the bore hole; said continuous lining tube having selected length portions in transverse alignment with said bore hole length portions and constructed for controlled radial expansion against said bore hole length portions relative to the remainder of said lining tube, and weakened means at each of said selected length portions for weakening said selected length portions in response to the application of force, said weakened means being varied at different selected length portions to provide different predetermined expansion characteristics for different selected length portions.

9. A continuous lining tube as set forth in claim 8 wherein said continuous lining tube comprises a plurality of jointed sections.

10. A continuous lining tube as set forth in claim 9 wherein said slots comprise circular openings and said continuous lining tube comprises coiled tubing.

11. A continuous lining tube as set forth in claim 8 wherein said slots comprise elongate slots extending in an angular relation.

12. A method for inserting and expanding a continuous expandable slotted tube within an uncased bore hole comprising the following steps:

providing a plurality of longitudinally spaced selected expandable length portions of said continuous expandable slotted tube with different predetermined slot configurations to obtain different expansion characteristics;

inserting said expandable slotted tube downwardly within said bore hole to a position at which said plurality of selected length portions of said slotted tube are in transverse alignment with predetermined length portions of said bore hole; and expanding said longitudinally spaced selected length portions of said slotted tube radially outwardly into contact with said predetermined length portion of said bore hole.

13. The method for inserting and expanding a continuous expandable slotted tube within an uncased bore hole as set forth in claim 12 wherein the step of providing a plurality of longitudinally spaced expandable length portions includes the provision of non-weakened lengths between at least some of said selected expandable length portions of said continuous expandable slotted tube.

14. A method for positioning expandable coiled tubing within a bore hole comprising the following steps:

providing coiled tubing on a reel having a plurality of slotted patterns therein positioned at predetermined length portions of said coiled tubing;

injecting said coiled tubing within the bore hole to a predetermined position at which said plurality of slotted patterns are in transverse alignment with predetermined length portions of said bore hole; and expanding said slotted patterns radially outwardly into contact with said predetermined length portion of said bore hole.

15. The method for inserting coiled tubing within a bore hole as set forth in claim 14 wherein the step of providing a plurality of slotted patterns include the provision of weakened lengths between said slotted patterns.

16. The method for inserting coiled tubing as set forth in claim 14 wherein said slotted patterns include the provisions of weakened length portions along said coiled tubing.

17. A method for inserting a continuous expandable slotted tube from a cased bore hole into a deviated bore hole portion having a lateral junction and for injecting a predetermined fluid within the bore hole formation at the lateral junction; said method comprising the steps of:

providing a selected expandable length portion of said slotted tube within a predetermined slot formation suitable to form a porous area after expansion;

providing a non-expandable length portion adjacent each end of said expandable length portion;

inserting said expandable slotted tube downwardly within said bore hole to a position at which said selected expandable length portion is aligned transversely with said lateral junction and said non-expandable length portions are positioned in said bore hole adjacent opposite ends of said lateral junction;

expanding said selected expandable length portion radially outwardly into contact with said bore hole while providing a porous area; and then injecting a suitable fluid into said slotted tube for passing through said porous area into the bore hole formation at said lateral junction for isolation of the cased bore hole from a reservoir.

18. The method for inserting a continuous expandable slotted tube within a deviated bore hole as set forth in claim 17 wherein the step of injecting a suitable fluid into said slotted tube includes the injection of a polymer gel for isolation of said lateral junction.

19. A method of forming a coiled tubing string having a plurality of longitudinally spaced predetermined expandable length portions arranged for injection within a bore hole and comprising the steps of:

providing a predetermined pattern of slots on a flat strip of coiled tubing;

rolling said strip into a desired tubular shape;

welding said strip after being rolled into said desired tubular shape for forming said tubing;

winding said tubing onto a reel;

injecting the coiled tubing from said reel with said expandable length portions thereon within the bore hole to a position where said expandable length portions are transversely aligned with selected length portions of the bore hole; and expanding said expandable length portions radially into contact with the bore hole.

20. A method for inserting and expanding tubing within an uncased bore hole which has varying diameters along its length comprising the following steps:

providing a plurality of longitudinally spaced selected length portions of said tubing with selected slot configurations to obtain different expansion characteristics for expanding to different radial diameters for conforming to the varying diameters of the bore hole;

inserting said expandable tubing downwardly within said bore hole to a position at which said plurality of selected length portions of said slotted tubing are in transverse alignment with predetermined length portions of said bore hole; and expanding said longitudinally spaced selected length portions of said slotted tubing radially outwardly into contact with said predetermined length portions of said bore hole with some of said selected length potions expanded radially a greater distance that other length portions for conforming generally to the adjacent bore hole.

21. The method for inserting and expanding tubing within an uncased bore hole as set forth in claim 20 wherein the step of providing a plurality of longitudinally spaced expandable length portions includes the providing of non-weakened tubing lengths between at least some of said selected slotted length portions of said tubing.

* * * * *